US011636787B2

(12) United States Patent
Tao

(10) Patent No.: US 11,636,787 B2
(45) Date of Patent: Apr. 25, 2023

(54) DISPLAY PANEL AND ELECTRONIC APPARATUS

(71) Applicant: WUHAN CHINA STAR OPTOELECTRONICS TECHNOLOGY CO., LTD., Wuhan (CN)

(72) Inventor: Jian Tao, Wuhan (CN)

(73) Assignee: WUHAN CHINA STAR OPTOELECTRONICS TECHNOLOGY CO., LTD., Wuhan (CN)

( * ) Notice: Subject to any disclaimer, the term of this patent is extended or adjusted under 35 U.S.C. 154(b) by 345 days.

(21) Appl. No.: 17/057,762

(22) PCT Filed: Sep. 29, 2020

(86) PCT No.: PCT/CN2020/118801
§ 371 (c)(1),
(2) Date: Nov. 23, 2020

(87) PCT Pub. No.: WO2022/056961
PCT Pub. Date: Mar. 24, 2022

(65) Prior Publication Data

US 2022/0301467 A1 Sep. 22, 2022

(30) Foreign Application Priority Data

Sep. 16, 2020 (CN) ..... 202010973911.8

(51) Int. Cl.
*G09G 3/00* (2006.01)

(52) U.S. Cl.
CPC ..... *G09G 3/006* (2013.01)

(58) Field of Classification Search
CPC ..... G09G 3/006; G09G 2300/0426; G09G 2330/12; G09G 3/20; G09F 9/00
USPC ..... 324/538, 537, 500
See application file for complete search history.

(56) References Cited

U.S. PATENT DOCUMENTS

| | | | | |
|---|---|---|---|---|
| 2018/0102492 | A1 | 4/2018 | Bibl et al. | |
| 2022/0190074 | A1* | 6/2022 | Zhao | H01L 51/0097 |
| 2022/0216290 | A1* | 7/2022 | Zheng | H01L 27/3276 |
| 2022/0231055 | A1* | 7/2022 | Qin | G09G 3/20 |

FOREIGN PATENT DOCUMENTS

| | | | |
|---|---|---|---|
| CN | 104867430 | A | 8/2015 |
| CN | 106291216 | A | 1/2017 |
| CN | 108364598 | A | 8/2018 |
| CN | 108845702 | A | 11/2018 |
| CN | 110579917 | A | 12/2019 |

(Continued)

*Primary Examiner* — Giovanni Astacio-Oquendo
(74) *Attorney, Agent, or Firm* — The Roy Gross Law Firm, LLC; Roy Gross

(57) ABSTRACT

A display panel and an electronic apparatus are provided. The display panel includes a substrate comprising a display section, a binding section, and a fan-out section disposed between the display section and the binding section. By disposing a first detecting module on the binding section, and a second detecting module on a side of the fan-out section adjacent to the display section to test whether the signal wires is normal, waste of back-end materials caused by broken signal wires is prevented, and product yields are increased.

20 Claims, 4 Drawing Sheets

(56) References Cited

FOREIGN PATENT DOCUMENTS

| | | | |
|---|---|---|---|
| CN | 110910804 | A | 3/2020 |
| CN | 111323949 | A | 6/2020 |
| CN | 111383554 | A | 7/2020 |
| CN | 111564111 | A | 8/2020 |

* cited by examiner

DISPLAY PANEL AND ELECTRONIC APPARATUS

CROSS REFERENCE TO RELATED APPLICATIONS

This application is a National Phase Entry of PCT/CN2020/118801 filed on Sep. 29, 2020 claiming priority to Chinese application 202010973911.8 filed Sep. 16, 2020. The contents of these applications are incorporated by reference in their entirety.

FIELD DISCLOSURE

The present disclosure relates to the technical field of displays, and in particular to a display panel and an electronic apparatus.

BACKGROUND OF DISCLOSURE

During a manufacturing process of display panels, properties of the display panels are required to be detected in respective stages to increase yields of the display panels. One of the most important detecting processes is to test an internal circuit of the display panel, find out problems in time, and repair the internal circuit. The process is referred to as a cell test.

SUMMARY OF INVENTION

Technical Problems

In existing technique, a test circuit of a panel is commonly disposed above signal wires of a fan-out section. However, since users' requirement for narrow bezels of display panels increases, a size of the fan-out section has become small, corresponding ones of the signal wires disposed on the fan-out section are thin, and the signal wires are easily fractured. However, the test circuit of panel disposed above the signal wires cannot test the signal wires. For large size products, the defect caused by the signal wires can only be found in a test in the next stage and thus causes waste of back-end materials and reduces product yields.

Technical Solutions

A display panel and an electronic apparatus are provided in the present disclosure, so as to solve the technical problem that a detecting circuit cannot detect the signal wires arranged on the fan-out section, and an increased risk of waste of back-end materials.

The present disclose provides a display panel, and the display panel includes:

a substrate including a display section, a binding section, and a fan-out section disposed between the display section and the binding section;

a plurality of data lines disposed on the display section and arranged along a first direction;

a plurality of signal wires disposed on the fan-out section, wherein the signal wires are connected to the data lines in one-to-one correspondence;

a first detecting module disposed on the binding section, wherein the first detecting module is electrically connected to the signal wires and configured to test whether the signal wires are normal; and a second detecting module disposed on a side of the fan-out section adjacent to the display section, wherein the second detecting module is electrically connected to the data lines and configured to test whether a display image of the display section is normal.

In the display panel provided by the present disclosure, the first detecting module includes a plurality of first switching elements, and the first switching elements have one-to-one correspondence to the signal wires;

a control terminal of each of the first switching elements is electrically connected to a first control signal pad, an input terminal of each of the first switching elements is electrically connected to a corresponding one of first test signal pads, and an output terminal of each of the first switching elements is electrically connected to a corresponding one of the signal wires.

In the display panel provided by the present disclosure, the first switching elements are arranged in at least one row along a second direction.

In the display panel provided by the present disclosure, the first switching elements are arranged in two rows along the second direction, and the first switching elements disposed on different rows are in alternate arrangement.

In the display panel provided by the present disclosure, the first switching elements are transistors.

A gate of each of the transistors is electrically connected to the first control signal pad, a source of each of the transistors is electrically connected to a corresponding one of the first test signal pads, and a drain of each of the transistors is electrically connected to a corresponding one of the signal wires.

In the display panel provided by the present disclosure, the first test signal pads are configured to receive a same data signal.

In the display panel provided by the present disclosure, the first detecting module includes a cut-off line and a plurality of signal connection lines, the signal connection lines are connected to the signal wires in one-to-one correspondence, and the cut-off line is electrically connected to the signal connection lines.

In the display panel provided by the present disclosure, the binding section includes a chip disposition region, and the chip disposition region is configured to bind a source driving chip.

The first detecting module is disposed in the chip disposition region.

In the display panel provided by the present disclosure, a plurality of first solder pads and a plurality of second solder pads are disposed in the chip disposition region, the first solder pads are arranged in a row along the second direction, the second solder pads are arranged in a row along the second direction, and the first solder pads and the second solder pads are arranged in different rows.

The first detecting module is disposed in a region between the first solder pads and the second solder pads.

In the display panel provided by the present disclosure, the second detecting module includes a plurality of second switching elements, and the second switching elements have one-to-one correspondence to the data lines.

A control terminal of each of the second switching elements is electrically connected to a second control signal pad, an input terminal of each of the second switching elements is electrically connected to a corresponding one of second test signal pads, and an output terminal of each of the second switching elements is electrically connected to a corresponding one of the data lines.

Accordingly, the present disclosure also provides an electronic apparatus including a display panel. The display panel includes:

a substrate including a display section, a binding section, and a fan-out section disposed between the display section and the binding section;

a plurality of data lines disposed on the display section and arranged along a first direction;

a plurality of signal wires disposed on the fan-out section, wherein the signal wires are connected to the data lines in one-to-one correspondence;

a first detecting module disposed on the binding section, wherein the first detecting module is electrically connected to the signal wires and configured to test whether the signal wires are normal; and a second detecting module disposed on a side of the fan-out section adjacent to the display section, wherein the second detecting module is electrically connected to the data lines and configured to test whether a display image of the display section is normal.

In the electronic apparatus provided by the present disclosure, the first detecting module includes a plurality of first switching elements, and the first switching elements have one-to-one correspondence to the signal wires; a control terminal of each of the first switching elements is electrically connected to a first control signal pad, an input terminal of each of the first switching elements is electrically connected to a corresponding one of first test signal pads, and an output terminal of each of the first switching elements is electrically connected to a corresponding one of the signal wires.

In the electronic apparatus provided by the present disclosure, the first switching elements are arranged in at least one row along a second direction.

In the electronic apparatus provided by the present disclosure, the first switching elements are arranged in two rows along the second direction, and the first switching elements disposed on different rows are in alternate arrangement.

In the electronic apparatus provided by the present disclosure, the first switching elements are transistors.

A gate of each of the transistors is electrically connected to the first control signal pad, a source of each of the transistors is electrically connected to a corresponding one of the first test signal pads, and a drain of each of the transistors is electrically connected to a corresponding one of the signal wires.

In the electronic apparatus provided by the present disclosure, the first test signal pads are configured to receive a same data signal.

In the electronic apparatus provided by the present disclosure, the first detecting module includes a cut-off line and a plurality of signal connection lines, the signal connection lines are connected to the signal wires in one-to-one correspondence, and the cut-off line is electrically connected to the signal connection lines.

In the electronic apparatus provided by the present disclosure, the binding section includes a chip disposition region, and the chip disposition region is configured to bind a source driving chip.

The first detecting module is disposed in the chip disposition region.

In the electronic apparatus provided by the present disclosure, a plurality of first solder pads and a plurality of second solder pads are disposed in the chip disposition region, the first solder pads are arranged in a row along the second direction, the second solder pads are arranged in a row along the second direction, and the first solder pads and the second solder pads are arranged in different rows.

The first detecting module is disposed in a region between the first pads and the second pads.

In the electronic apparatus provided by the present disclosure, the second detecting module includes a plurality of second switching elements, and the second switching elements have one-to-one correspondence to the data lines.

A control terminal of each of the second switching elements is electrically connected to a second control signal pad, an input terminal of each of the second switching elements is electrically connected to a corresponding one of second test signal pads, and an output terminal of each of the second switching elements is electrically connected to a corresponding one of the data lines.

Beneficial Effects

The present disclosure provides a display panel and an electronic apparatus. The display panel includes a substrate including a display section, a binding section, and a fan-out section disposed between the display section and the binding section. A first detecting module is disposed on the binding section, and a second detecting module is disposed on a side of the fan-out section adjacent to the display section. On the basis of testing whether a display image is normal by the second detecting module, the first detecting module may be configured to test whether the signal wires on the fan-out section is normal, so that waste of back-end materials caused by broken signal wires is prevented, and product yields are increased.

BRIEF DESCRIPTION OF DRAWINGS

In order to clearly illustrate the technical solutions in the embodiments of the present disclosure, the drawings used in the description of the embodiments will be briefly introduced below. Obviously, the drawings in the following description are only some embodiments of the disclosure. Other drawings can also be obtained from those skilled in the art based on these drawings without paying any inventive effort.

DETAILED DESCRIPTION OF EMBODIMENTS

Figure 1:
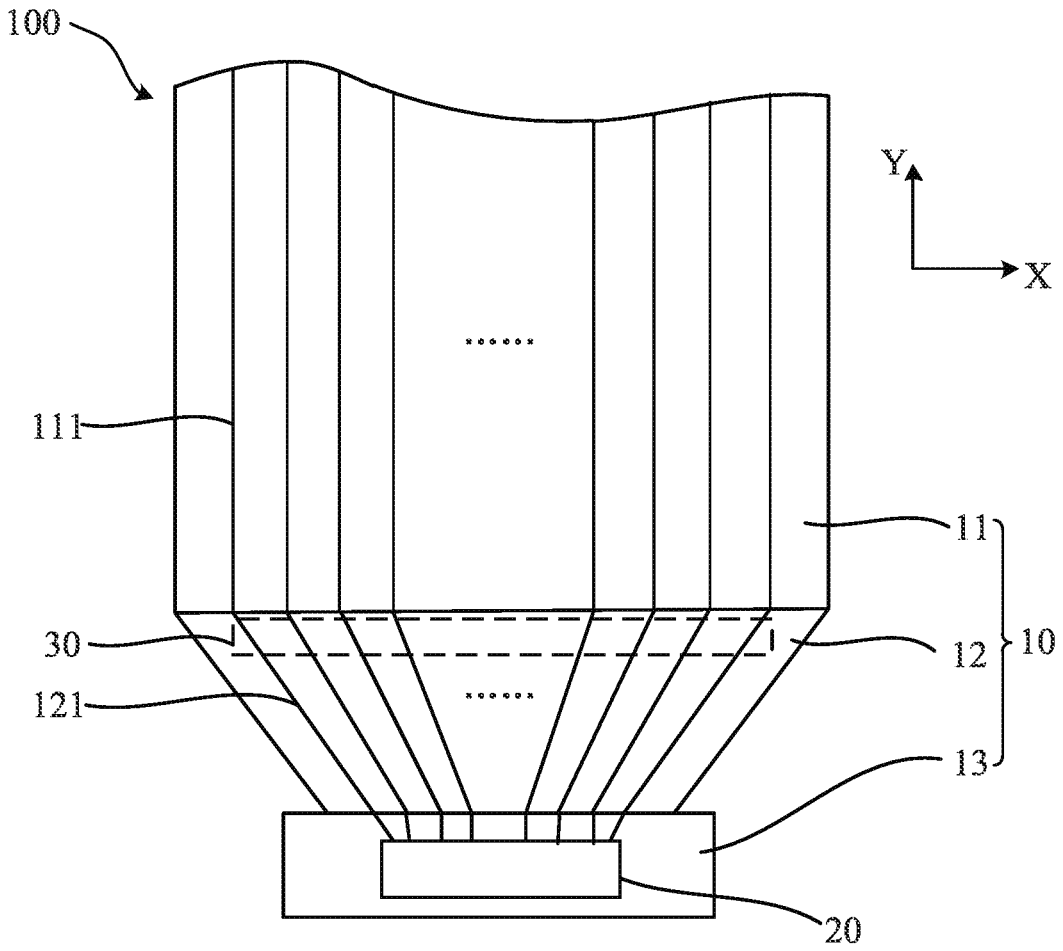
FIG. 1 is a schematic view of a first planar structure of a display panel provided by the present disclosure.

The technical solutions in the embodiments of the present disclosure are clearly and completely described in the following description, which is combined with the drawings in the embodiments of the present disclosure. Obviously, the embodiments described in the following description are only a part of the embodiments of the disclosure, not all the embodiments. Other embodiments obtained from those skilled in the art based on the embodiments of the present disclosure without paying any inventive effort belong to a protected scope of the present disclosure.

In the description of the present disclosure, the terms "first" and "second" are used for descriptive purposes only, and cannot be realized as indicating or implying relative importance or implying the number of indicated technical features. Thus, the technical features defined as "first" and "second" may explicitly or implicitly include one or more of the technical features. In the description of the present disclosure, a meaning of "a plurality of" is two or more, unless specifically defined.

In the description of the present application, it is noted that the terms "mount", "link", and "connect" should be understood in a broad sense. For example, it may be a fixed connection, a detachable connection, or an integral connection; it may be a mechanical connection, an electrical connection, or it may communicate with each other; it may be a direct connection, or an indirect connection through an intermediate medium, and it may be a connection within two elements or an interaction between two elements. The specific meaning of the above terms in the present disclosure can be understood by a person of ordinary skill in the art based on the specific situations.

In the description of the present disclosure, unless specifically defined, a first feature "above" or "below" a second feature can include the first feature in direct contact with the second feature or the first feature in contact with the second feature via another feature, not direct contact. Moreover, the first feature "above", "on", and "over" the second feature can include the first feature directly above and obliquely above the second feature, or merely indicate that a horizontal height of the first feature is higher than a horizontal height of the second feature. The first feature "below", "under", and "beneath" the second feature can include the first feature directly below and obliquely below the second feature, or merely indicate that the horizontal height of the first feature is lower than the horizontal height of the second feature.

It is noted that a first switching element or a second switching element used in all the embodiments of the present disclosure may be a thin-film transistor or a field effect transistor or other devices with same characteristics. Because a source and a drain of the transistor used in the embodiments of the present disclosure are symmetric, the drain and the source of the transistor are interchangeable. In the embodiments of the present disclosure, in order to distinguish the two terminals of a transistor other than a gate, one is referred to as a source and the other is referred to as a drain. A middle terminal of the transistor is the gate, a signal input terminal of the transistor is the source, and an output terminal of the transistor is the drain according to shapes thereof in the figures. Furthermore, the transistor used in the embodiments of the present disclosure may include a P-type transistor and/or an N-type transistor, wherein the P-type transistor turns on when the gate is at a low level and turns off when the gate is at a high level, and the N-type transistor turns on when the gate is at a high level and turns off when the gate is at a low level.

Please refer to FIG. 1. FIG. 1 is a first planar structure of a display panel provided by the present disclosure.

A display panel 100 is provided by an embodiment of the present disclosure. The display panel 100 includes a substrate 10 including a display section 11, a binding section 13, and a fan-out section 12 disposed between the display section 11 and the binding section 13; a plurality of data lines 111 disposed on the display section 11 and arranged along a first direction Y. A plurality of signal wires 121 are disposed on the fan-out section 12, and the signal wires 121 are connected to the data lines 111 in one-to-one correspondence. A first detecting module 20 is disposed on the binding section 13, and the first detecting module 20 is electrically connected to the signal wires 121 and configured to test whether the signal wires 121 are normal. A second detecting module 30 is disposed on a side of the fan-out section 12 adjacent to the display section 11, and the second detecting module 30 is electrically connected to the data lines 111 and configured to test whether a display image of the display section 11 is normal.

In the embodiments of the present disclosure, the first detecting module 20 is disposed on the binding section 13, and the second detecting module 30 is disposed on a side of the fan-out section 12 adjacent to the display section 11. After the second detecting module 20 is used to test whether a display image is normal, and the corresponding repair work is performed, the first detecting module 20 is used to test whether the signal wires 121 on the fan-out section 12 is broken, so that waste of back-end materials caused by broken signal wires 121 is prevented, and product yields are increased.

Understandably, in the display panel 100 of the embodiments of the present disclosure, a detecting process of the first detecting module 20 and the second detecting module 30 includes steps as below. First, the second detecting module 30 is turned on, the display image of the display section 11 is tested by the second detecting module 30, and the display image is repaired in correspondence according to specific display abnormality (bright dots or dark lines). Then, the second detecting module 30 is turned off, the first detecting module 20 is turned on, and the signal wires 121 are tested by the first detecting module 20. If a dark line appears on the display image, it means that a corresponding one of the signal wires 121 is broken.

After the second detecting module 30 is turned off, it is considered that the display abnormality tested by the first detecting module 20 is caused by the defect of the signal wires 121 because the wires above the fan-out section 12 in the display panel 100 are already tested by the second detecting module 30 and repaired in correspondence.

Figure 2:
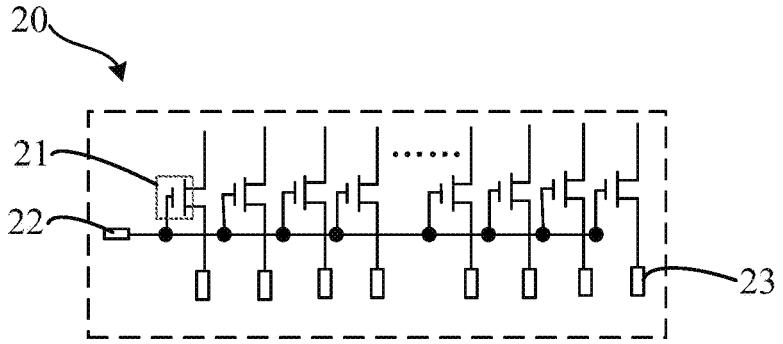
FIG. 2 is a schematic view of a first circuit of a first detecting module provided by the present disclosure.

Please refer to FIG. 2. FIG. 2 is a schematic view of a first circuit of the first detecting module provided by the present disclosure.

In the present embodiment, the first detecting module 20 includes a plurality of first switching elements. The first switching elements 21 have one-to-one correspondence to the signal wires 121. A control terminal of each of the first switching elements 21 is electrically connected to a first control signal pad 22. An input terminal of each of the first switching elements 21 is electrically connected to a corresponding one of first test signal pads 23. An output terminal of each of the first switching elements 21 is electrically connected to a corresponding one of the signal wires 121.

The first control signal pad 22 is configured to receive a control signal, so as to control the first switching elements 21 to turn on or turn off. During a process of cell test, in order to simplify the steps, it is necessary to ensure that the plurality of first switching elements 21 corresponding to the plurality of signal wires 121 are simultaneously turned on and simultaneously turned off, so the control terminals of the plurality of first switching elements 21 are connected to the same first control signal pad 22.

Certainly, in other embodiments, the quantity of the first control signal pad 22 may also be plural, as long as the control signals are simultaneously inputted to control the plurality of first switching elements 21 to simultaneously turn on and simultaneously turn off, which is not limited in the present disclosure.

The first test signal pads 23 are configured to receive data signals, and the data signals are transmitted to the display section 11 via the signal wires 121 and the data lines, so as to display the image.

Specifically, the same data signals may be inputted to the plurality of first test signal pads 23 by an external lighting device, so that the display section 11 displays the same grayscale image. For example, if the dark line appears on the display image when the display section 11 displays a full white image, it is indicated that a corresponding one of the signal wires 121 is broken. Definitely, the different data signals may also be inputted to the first test signal pads 23 by the external lighting device, so that the display section 11 displays a different grayscale image.

In the present embodiment, the first switching elements 21 may be transistors. Specifically, a gate of each of the transistors is electrically connected to the first control signal pad 22. A source of each of the transistors is electrically connected to a corresponding one of the first test signal pads 23. A drain of each of the transistors is electrically connected to a corresponding one of the signal wires 121.

The transistors may be low-temperature polysilicon thin-film transistors, oxide semiconductor thin-film transistors, or amorphous silicon thin-film transistors. Preferably, the transistors in the first detecting module 10 provided by the present embodiment are the same type transistors, so as to prevent the effect caused by the difference between the different type transistors on the first detecting module 20.

Further, in the present embodiment, the first switching elements 21 are arranged in at least one row along a second direction X. The first switching elements 21 are arranged in one row, two rows, or three rows along the second direction X, which may be specifically set according to the size of an area of the binding section 13 and is not limited in the present disclosure.

Specifically, please continue to refer to FIG. 2. In the present embodiment, the first switching elements 21 are arranged in one row along the second direction X. When the size of the binding section 13 along the second direction X is large, the plurality of first switching elements 21 are arranged in one row along the second direction X, and signal crosstalk and short circuit do not occur between the first switching elements 21.

Figure 3:
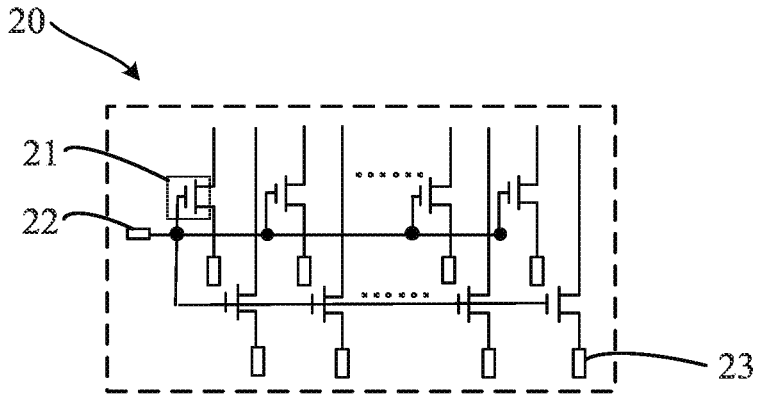
FIG. 3 is a schematic view of a second circuit of the first detecting module provided by the present disclosure.

In another embodiment of the present disclosure, please refer to FIG. 3. FIG. 3 is a schematic view of a second circuit of the first detecting module provided by the present disclosure. Different from the first detecting module 20 shown in FIG. 2, in the present embodiment, the first switching elements 21 are arranged in two rows along the second direction X, and the first switching elements 21 disposed on different rows are in alternate arrangement.

Understandably, when the size of the binding section 13 along the second direction X is small, the first switching elements 21 are arranged in two rows along the second direction X and in alternate arrangement, so that the signal crosstalk and short circuit occurring between the first switching elements 21 in the same row due to the small space is prevented, and the detecting accuracy is increased.

Figure 4:
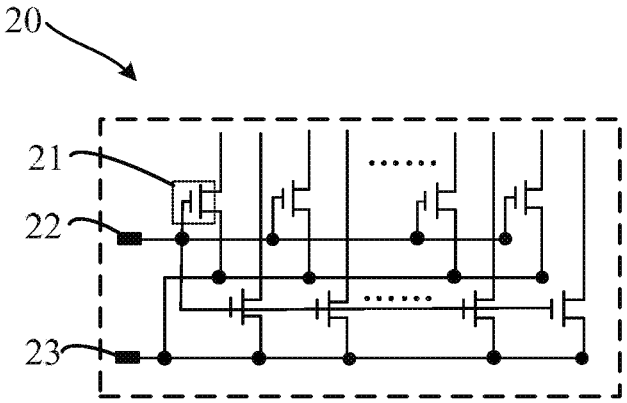
FIG. 4 is a schematic view of a third circuit of the first detecting module provided by the present disclosure.

Further, please refer to FIG. 4. FIG. 4 is a schematic view of a third circuit of the first detecting module provided by the present disclosure. Different from the first detecting module 20 shown in FIG. 3, in the present embodiment, the quantity of the first test signal pad 23 is one.

It is known from the above contents that the first detecting module 20 only needs to test whether the signal wires are broken. Therefore, it only needs to provide a white image to the display section 11 through the first test signal pad 23 by using the external lighting device. When a dark line appears on the display image of display section 11, it can determine whether a corresponding one of the signal wires 121 is broken. The circuit design reduces the detecting difficulty and simplifies an electric structure of the first detecting module 20, so as to reduce an area of the binding section 13 and satisfy a requirement for a narrow bezel of the display panel 100.

Figure 5:
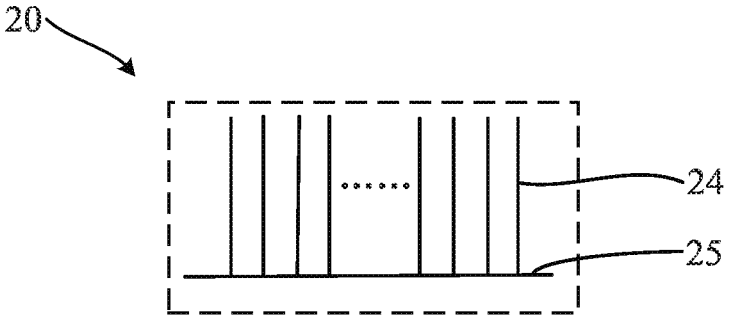
FIG. 5 is a schematic view of a fourth circuit of the first detecting module provided by the present disclosure.

Please refer to FIG. 5. FIG. 5 is a schematic view of a fourth circuit of the first detecting module provided by the present disclosure.

In the present embodiment, the first detecting module 20 includes a cut-off line 25 and a plurality of signal connection lines 24. The signal connection lines 24 are connected to the signal wires 121 in one-to-one correspondence. The cut-off line 25 is electrically connected to the signal connection lines 24.

The signal wires 121 are short-circuited together by the cut-off line 25 in the embodiments of the present disclosure. During testing, the data signals may be transmitted to the display section 11 through the cut-off line 25, the signal wires 121, and data lines 11 by the external lighting device, and then to test whether the defect of the corresponding one of the signal wires 121 exists. The circuit design can realize the simultaneous test of the signal wires 121. After the test is finished, the signal wires 121 connecting the cut-off line 25 needs to be cut by a cutting technique, so as to prevent the cut-off line 25 from influencing the regular operation of the display panel 100.

Figure 6:
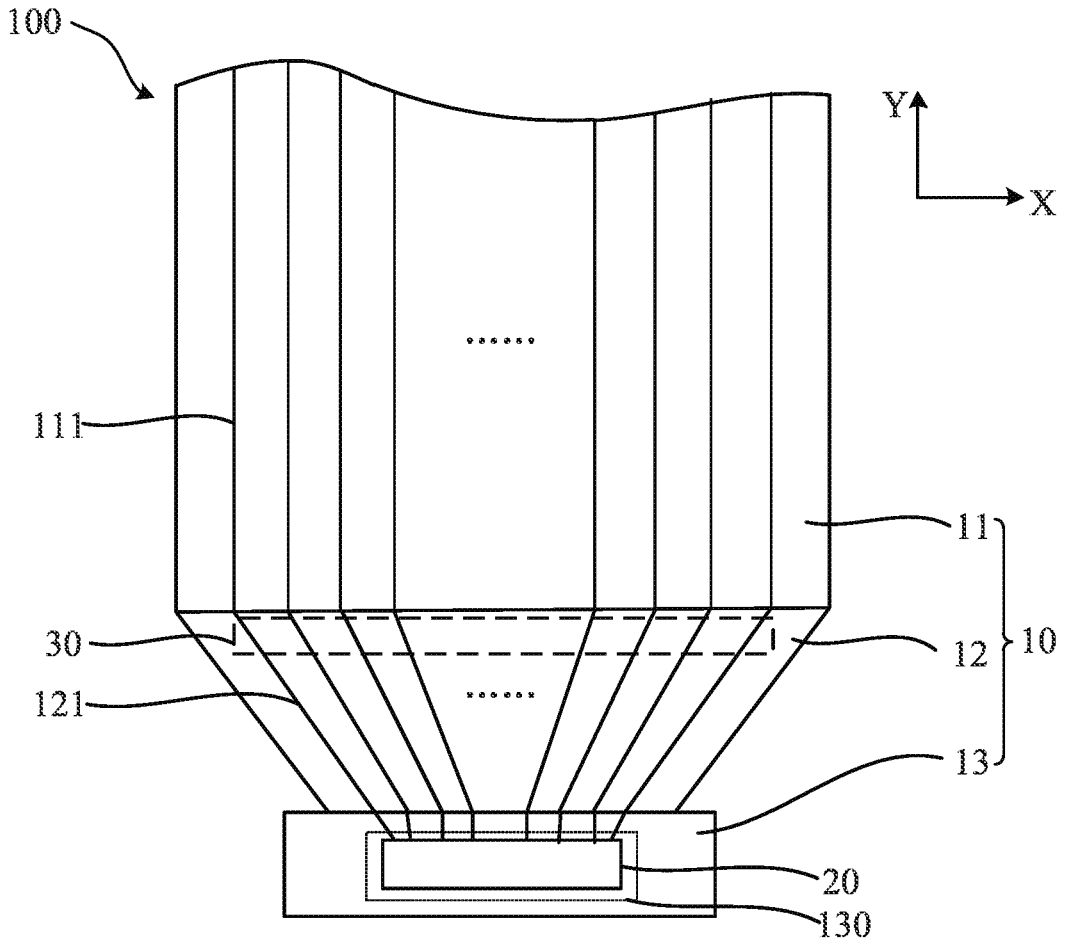
FIG. 6 is a schematic view of a second planar structure of a display panel provided by the present disclosure.

Please refer to FIG. 6. FIG. 6 is a schematic view of a second planar structure of a display panel provided by the present disclosure. Different from the display panel 100 shown in FIG. 1, in the present embodiment, the binding section 13 includes a chip disposition region 130. The chip disposition region 130 is configured to bind a source driving chip (not shown in the figures). It is noted that the quantity of the source driving chip may be singular or plural, which is not limited in the present disclosure.

The first detecting module 20 is disposed in the chip disposition region 130. An orthographic projection of the first detecting module 20 projected on the substrate 10 at least partially overlaps an orthographic projection of the source driving chip projected on the substrate 10.

Figure 7:
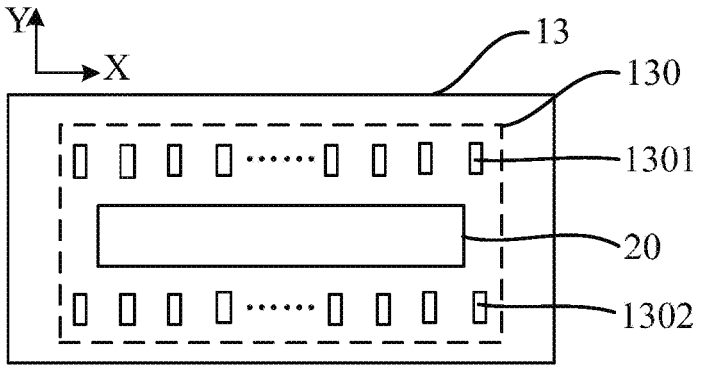
FIG. 7 is a schematic view of a structure of a binding section in FIG. 6.

Further, please refer to FIG. 7. FIG. 7 is a schematic view of a structure of a binding section in FIG. 6.

In the present embodiment, a plurality of first solder pads 1301 and a plurality of second solder pads 1302 are disposed in the chip disposition region 130. The first solder pads 1301 are arranged in a row along the second direction X. The second solder pads 1302 are arranged in a row along the second direction X. The first solder pads 1301 and the second solder pads 1302 are arranged in different rows. The first detecting module 20 is disposed in a region between the first solder pads 1301 and the second solder pads 1302.

Understandably, in the display panel 100 of the present embodiment, after the cell test is finished, the source driving chip needs to be bound onto the binding section 13 by the first solder pads 1301 and the second solder pads 1302. The first solder pads 1301 are configured to transmit the data signals outputted by the source driving chip to the display panel 100. The second solder pads 1302 are configured for the source driving chip to receive signals provided by a timing controller chip or a gamma chip on a circuit board, which are not redundantly described herein.

Since the first detecting module 20 is disposed in a region between the first solder pads 1301 and the second solder pads 1302, the first detecting module 20 shares the same space in the chip deposition region 130 with the source driving chip, which can effectively reduce an area of the binding section 13.

Further, the size of the first switching elements 21 does not influence the testing signals transmitted to the display section 11 since the first switching elements 21 only need to function as a switch for turning on and turning off. Thus, the size of the first switching elements 21 can be reduced as small as possible, so as to reduce the space occupied by the first detecting circuit 20, achieve the purpose of placing the first detecting circuit 20 in the region between the plurality of first solder pads 1301 and the plurality of second solder pads 1302, further reduce the area of the binding section 13, and satisfy a requirement for a narrow bezel of the display panel 100.

Figure 8:
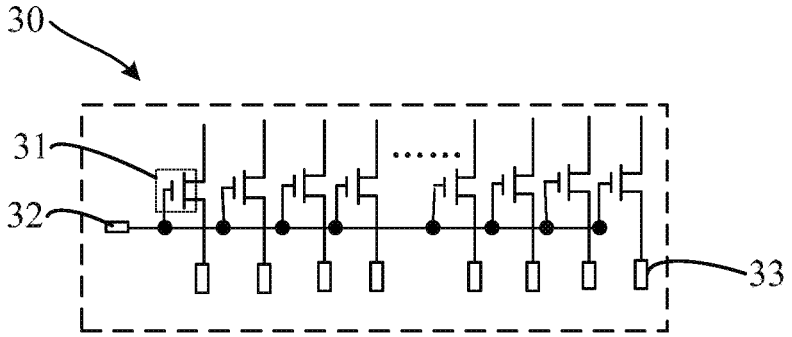
FIG. 8 is a schematic view of a circuit of a second detecting module provided by the present disclosure.

Please refer to FIG. 8. FIG. 8 is a schematic view of a circuit of a second detecting module provided by the present disclosure.

In the embodiments of the present disclosure, the second detecting module 30 includes a plurality of second switching elements 31. The second switching elements 31 have one-to-one correspondence to the data lines 111. A control terminal of each of the second switching elements 31 is electrically connected to a second control signal pad 32. An input terminal of each of the second switching elements 31 is electrically connected to a corresponding one of second test signal pads 33. An output terminal of each of the second switching elements 31 is electrically connected to a corresponding one of the data lines 111.

The second control signal pad 32 is configured to receive a control signal, so as to control the second switching elements 31 to turn on or turn off. During a process of cell test, in order to simplify the steps, it is necessary to ensure that the plurality of second switching elements 31 corresponding to the plurality of data lines 111 are simultaneously turned on and simultaneously turned off, so the control terminals of the plurality of second switching elements 31 are connected to the same second control signal pad 32.

Certainly, in other embodiments, the quantity of the second control signal pads 32 may also be plural, as long as the control signals are simultaneously inputted to control the plurality of second switching elements 31 to simultaneously turn on and simultaneously turn off, which is not limited in the present disclosure.

The second test signal pads 33 are configured to receive data signals, and the data signals are transmitted to the display section 11 via the data lines 111, so as to display the image. It is noted that the same data signals may be inputted to the plurality of second test signal pads 33 by the external lighting device, so that the display section 11 displays the same grayscale image. The different data signals may also be inputted to the second test signal pads 33 by the external lighting device, so that the display section 11 displays a different grayscale image. Specifically, it can be set according to the actual requirement of the panel test.

The second switching elements 31 may be low-temperature polysilicon thin-film transistors, oxide semiconductor thin-film transistors, or amorphous silicon thin-film transistors. Preferably, the transistors in the second detecting module 30 provided by the present embodiment are the same type transistors, so as to prevent the effect caused by the difference between the different type transistors on the second detecting module 30.

Further, in an embodiment of the present disclosure, the size of the second switching elements 31 is greater than the size of the first switching elements 21.

Correspondingly, the present disclosure provides an electronic apparatus. The electronic apparatus includes the display panel described in any one of the above embodiments. For the display device, specifically refer to the contents above, which are not redundantly described herein. Moreover, the electronic apparatus may be smartphones, tablets, e-book readers, smartwatches, cameras, game consoles, etc., which are not limited in the present disclosure.

The present disclosure provides an electronic apparatus including a display panel. The display panel includes a substrate including a display section, a binding section, and a fan-out section disposed between the display section and the binding section. A plurality of data lines are disposed on the display section and arranged along a first direction. A plurality of signal wires are disposed on the fan-out section, wherein the signal wires are connected to the data lines in one-to-one correspondence. A first detecting module is disposed on the binding section, and a second detecting module is disposed on a side of the fan-out section adjacent to the display section. After the second detecting module is used to test whether a display image is normal, and the corresponding repair work is performed, the first detecting module is used to test whether the signal wires on the fan-out section is broken, so that waste of back-end materials caused by broken signal wires is prevented, and product yields are increased.

The display device and the electronic apparatus provided by the present disclosure are described in detail as above. The principles and embodiments of the present disclosure are described in the specific examples. The description of the embodiments is only for helping understand the technical solutions and its core idea of the present disclosure. Furthermore, for those skilled in the art, the specific embodiments and scope of application may vary based on the idea of the present disclosure. In summary, the contents of the present specification should not be regarded as limitations to the present disclosure.

What is claimed is:

1. A display panel, comprising:

a substrate comprising a display section, a binding section, and a fan-out section disposed between the display section and the binding section;

a plurality of data lines disposed on the display section and arranged along a first direction;

a plurality of signal wires disposed on the fan-out section, wherein the signal wires are connected to the data lines in one-to-one correspondence;

a first detecting module disposed on the binding section, wherein the first detecting module is electrically connected to the signal wires and configured to test whether the signal wires are normal; and a second detecting module disposed on a side of the fan-out section adjacent to the display section, wherein the second detecting module is electrically connected to the data lines and configured to test whether a display image of the display section is normal.

2. The display panel as claimed in claim 1, wherein the first detecting module comprises a plurality of first switching elements, and the first switching elements have one-to-one correspondence to the signal wires; a control terminal of each of the first switching elements is electrically connected to a first control signal pad, an input terminal of each of the first switching elements is electrically connected to a corresponding one of first test signal pads, and an output terminal of each of the first switching elements is electrically connected to a corresponding one of the signal wires.

3. The display panel as claimed in claim 2, wherein the first switching elements are arranged in at least one row along a second direction.

4. The display panel as claimed in claim 3, wherein the first switching elements are arranged in two rows along the second direction, and the first switching elements disposed on different rows are in alternate arrangement.

5. The display panel as claimed in claim 2, wherein the first switching elements are transistors, wherein a gate of each of the transistors is electrically connected to the first control signal pad, a source of each of the transistors is electrically connected to a corresponding one of the first test signal pads, and a drain of each of the transistors is electrically connected to a corresponding one of the signal wires.

6. The display panel as claimed in claim 2, wherein the first test signal pads are configured to receive a same data signal.

7. The display panel as claimed in claim 1, wherein the first detecting module comprises a cut-off line and a plurality of signal connection lines, the signal connection lines are connected to the signal wires in one-to-one correspondence, and the cut-off line is electrically connected to the signal connection lines.

8. The display panel as claimed in claim 1, wherein the binding section comprises a chip disposition region, and the chip disposition region is configured to bind a source driving chip, wherein the first detecting module is disposed in the chip disposition region.

9. The display panel as claimed in claim 8, wherein a plurality of first solder pads and a plurality of second solder pads are disposed in the chip disposition region, the first solder pads are arranged in a row along the second direction, the second solder pads are arranged in a row along the second direction, and the first solder pads and the second solder pads are arranged in different rows;

wherein the first detecting module is disposed in a region between the first solder pads and the second solder pads.

10. The display panel as claimed in claim 1, wherein the second detecting module comprises a plurality of second switching elements, and the second switching elements have one-to-one correspondence to the data lines; a control terminal of each of the second switching elements is electrically connected to a second control signal pad, an input terminal of each of the second switching elements is electrically connected to a corresponding one of second test signal pads, and an output terminal of each of the second switching elements is electrically connected to a corresponding one of the data lines.

11. An electronic apparatus, comprising a display panel, wherein the display panel comprises: a substrate comprising a display section, a binding section, and a fan-out section disposed between the display section and the binding section;

a plurality of data lines disposed on the display section and arranged along a first direction;

a plurality of signal wires disposed on the fan-out section, wherein the signal wires are connected to the data lines in one-to-one correspondence;

a first detecting module disposed on the binding section, wherein the first detecting module is electrically connected to the signal wires and configured to test whether the signal wires are normal; and a second detecting module disposed on a side of the fan-out section adjacent to the display section, wherein the second detecting module is electrically connected to the data lines and configured to test whether a display image of the display section is normal.

12. The electronic apparatus as claimed in claim 11, wherein the first detecting module comprises a plurality of first switching elements, and the first switching elements have one-to-one correspondence to the signal wires; a control terminal of each of the first switching elements is electrically connected to a first control signal pad, an input terminal of each of the first switching elements is electrically connected to a corresponding one of first test signal pads, and an output terminal of each of the first switching elements is electrically connected to a corresponding one of the signal wires.

13. The electronic apparatus as claimed in claim 12, wherein the first switching elements are arranged in at least one row along a second direction.

14. The electronic apparatus as claimed in claim 13, wherein the first switching elements are arranged in two rows along the second direction, and the first switching elements disposed on different rows are in alternate arrangement.

15. The electronic apparatus as claimed in claim 12, wherein the first switching elements are transistors, wherein a gate of each of the transistors is electrically connected to the first control signal pad, a source of each of the transistors is electrically connected to a corresponding one of the first test signal pads, and a drain of each of the transistors is electrically connected to a corresponding one of the signal wires.

16. The electronic apparatus as claimed in claim 12, wherein the first test signal pads are configured to receive a same data signal.

17. The electronic apparatus as claimed in claim 11, wherein the first detecting module comprises a cut-off line and a plurality of signal connection lines, the signal connection lines are connected to the signal wires in one-to-one correspondence, and the cut-off line is electrically connected to the signal connection lines.

18. The electronic apparatus as claimed in claim 11, wherein the binding section comprises a chip disposition region, and the chip disposition region is configured to bind a source driving chip, wherein the first detecting module is disposed in the chip disposition region.

19. The electronic apparatus as claimed in claim 18, wherein a plurality of first solder pads and a plurality of second solder pads are disposed in the chip disposition region, the first solder pads are arranged in a row along the second direction, the second solder pads are arranged in a row along the second direction, and the first solder pads and the second solder pads are arranged in different rows;

wherein the first detecting module is disposed in a region between the first solder pads and the second solder pads.

20. The electronic apparatus as claimed in claim 11, wherein the second detecting module comprises a plurality of second switching elements, and the second switching elements have one-to-one correspondence to the data lines; a control terminal of each of the second switching elements is electrically connected to a second control signal pad, an input terminal of each of the second switching elements is electrically connected to a corresponding one of second test signal pads, and an output terminal of each of the second switching elements is electrically connected to a corresponding one of the data lines.

* * * * *